US005448281A

United States Patent [19]

Walter et al.

[11] Patent Number: 5,448,281

[45] Date of Patent: Sep. 5, 1995

[54] PRINT HEAD PRESSURE ADJUSTMENT MECHANISM

[75] Inventors: Graham D. Walter, Peterborough; Gary F. Fowler, Keene; John H. Johansen, East Swanzey; Michael G. Morin, Keene, all of N.H.

[73] Assignee: Markem Corporation, Keene, N.H.

[21] Appl. No.: 304,201

[22] Filed: Sep. 12, 1994

Related U.S. Application Data

[62] Division of Ser. No. 818,759, Jan. 10, 1992, Pat. No. 5,379,050.

[51] Int. Cl.[6] ..... B41J 25/304

[52] U.S. Cl. ..... 347/198; 346/33 WL

[58] Field of Search ..... 346/76 PH, 33 WL; 400/120; 347/198

[56] References Cited

U.S. PATENT DOCUMENTS

| | | | |
|---|---|---|---|
| 1,820,194 | 8/1931 | Huebner . | |
| 3,263,606 | 8/1966 | Poynter | 101/179 |
| 3,593,661 | 7/1971 | Tripp | 101/175 |
| 4,385,302 | 5/1983 | Moriguchi et al. | 346/76 PH |
| 4,526,487 | 7/1985 | Ikeda | 400/201 |
| 4,540,992 | 9/1985 | Moteki et al. | 346/76 PH |
| 4,654,673 | 3/1987 | Yanata et al. | 346/76 PH |
| 4,833,982 | 5/1989 | Liebert et al. | 100/177 |
| 5,022,318 | 6/1991 | Alich | 100/47 |
| 5,038,155 | 8/1991 | Yamagishi et al. | 366/76 PH |

FOREIGN PATENT DOCUMENTS

| | | |
|---|---|---|
| 0004736 | 10/1979 | European Pat. Off. . |
| 0050481 | 4/1982 | European Pat. Off. . |
| 0106683 | 4/1984 | European Pat. Off. . |
| 0184132 | 6/1986 | European Pat. Off. . |
| 0361826 | 4/1990 | European Pat. Off. . |
| 0371718 | 6/1990 | European Pat. Off. . |
| 0388763 | 9/1990 | European Pat. Off. . |
| 0424610 | 5/1991 | European Pat. Off. . |
| 3736361 | 5/1988 | Germany . |
| 57-116663 | 7/1982 | Japan . |
| 59-232881 | 12/1984 | Japan . |
| 61-135770 | 6/1986 | Japan . |
| 63-166552 | 7/1988 | Japan . |
| 2254829 | 10/1992 | United Kingdom . |
| 1207805 | 1/1986 | U.S.S.R. . |

OTHER PUBLICATIONS

C. Rothwell, "High Speed Single Pass Thermal Transfer Color Printing and Plotting", Atlankek Inc., Fourth Annual Thermal Printing Workshop, Cambridge, Massachusetts (Mar. 22–24, 1993).

Excerpts from Markem Corporation Models LP-39 and LP-39L Operating Instructions (1970).

Excerpts from Markem Corporation Model LP-375 Operating Instructions (1980).

Excerpts from Markem Corporation Model 521 Operator Instructions (1983).

*Primary Examiner*—Huan H. Tran

*Attorney, Agent, or Firm*—Roylance, Abrams, Berdo & Goodman

[57] ABSTRACT

A printing pressure adjustment system and a method for adjusting the pressure applied by a print head against a backup member are disclosed. The adjustment system includes an elongated member that is slidably displaceable with respect to an outer surface of the print head. The elongated member has an inclined bearing surface on which a biasing member is positioned in order to apply a force to the elongated member. The elongated member includes a load transfer surface for transferring the biasing force to the print head.

13 Claims, 8 Drawing Sheets

PRINT HEAD PRESSURE ADJUSTMENT MECHANISM

This is a division of application Ser. No. 07/818,759, filed Jan. 10, 1992, U.S. Pat. No. 5,379,056.

BACKGROUND OF THE INVENTION

The present invention relates to a multi-color thermal transfer printing apparatus that employs a plurality of separate thermal print heads and particularly concerns a generally arcuate arrangement for the print heads whereby registration errors may be minimized. The present invention also particularly concerns a pressure adjuster for use on a thermal print head in order to adjust the print pressure.

Typical thermal print heads currently available generally comprise a flat ceramic substrate that is provided on one side with a plurality of thermal elements and the necessary electronic circuitry for controlling the activation of the thermal elements. The electronic circuitry is typically covered by a shield for protecting the circuitry from foreign particles, moisture, and other damaging contact. Although the configuration of the electronics shield may vary from print head to print head, the shield normally protrudes substantially from the surface of the ceramic substrate. Mounted on the opposite side of the ceramic substrate, typically, is an aluminum heat sink for providing cooling.

In operation, the thermal print head is usually used in conjunction with a platen and an ink transfer foil that carries a thermal transfer ink. The substrate to be printed and the ink foil are presented to the print head between the thermal elements of the print head and the platen such that the ink foil is adjacent to the print head and the- substrate is adjacent to the platen. The print head is then biased against the platen, and selected thermal elements are heated to effect a transfer of the ink from the ink foil to the substrate surface. With a typical thermal print head, the substrate to be printed and the ink foil must be introduced to the print head at an angle sufficient to clear the on-board print head electronics and electronics shield. If more than one print head is used for a particular printing job and the print heads are arranged in a straight line, a roller must follow each print head in order to ensure that the substrate enters the printing area of the next print head at the proper angle to clear the electronics. However, each roller that the web must wrap around introduces some error that can effect print registration. Where multiple print heads are in use, proper registration between print heads as well as between the substrate to be printed and each print head is necessary in order to avoid color overlap or other printing errors relating to the improper positioning of the ink on the sheet.

In addition to proper registration, the proper pressure and thermal energy must be applied by the print head to the substrate and ink foil in order to produce a good quality print. Different widths of the substrate and/or foil can affect the amount of print pressure required for satisfactory printing. For example, wider substrate and foil widths require additional print head pressure, whereas narrower widths require less pressure. If the same print head is to be used for substrates and ink foils of different widths, the print head pressure must be adjusted whenever the substrate or ink foil width is changed.

SUMMARY OF THE INVENTION

The present invention provides a printing system having a series of print stations arranged so that printing registration errors may be minimized. The printing system is operable to print onto a continuous substrate. Each print station includes a print head having a printing surface for printing images on the continuous substrate and a platen against which the printing surface is applied during printing. A substrate drive system is provided for advancing the substrate past each of the printing surfaces of the series of print stations. The print stations are arranged in a generally arcuate arrangement whereby the continuous substrate follows a substantially straight path between printing surfaces of adjacent print stations.

The printer system also includes a foil supply system operable to position an ink foil between the printing surfaces and the continuous substrate. The foil supply system includes a plurality of separate foil drive assemblies with each foil drive assembly being coupled to one of the print stations.

The present invention also provides a method for multi-color printing by thermal transfer that includes the steps of introducing a continuous substrate substantially along a first plane to a first printing area between a first printing surface of a first thermal print head and a first backup surface, and printing a first color on the continuous substrate. The method further includes the step of withdrawing the continuous substrate from the first printing area substantially along a second plane disposed at an angle to the first plane, and introducing the continuous substrate substantially along the second plane to a second printing area that is between a second printing surface of a second thermal print head and a second resisting surface. The method includes the step of printing a second color on the continuous substrate.

The present invention also provides a system for adjusting the pressure of a print head with respect to a backup member. The system includes a print head having a print surface and an outer surface generally opposite to the print surface. A backup member is positioned adjacent to the print head. An elongated member is provided that is slidably displaceable with respect to the print head outer surface. The elongated member defines a bearing surface and a force transfer surface. The system also includes a biasing system that is engageable with the elongated member bearing surface and is operable to transfer force through the force transfer surface in order to urge the print head toward the backup member and thereby apply a variable, user-selected level of print head pressure.

The present invention further includes a method for adjusting the pressure exerted by a print head with respect to a backup member. The method includes the step of positioning a print head print surface in opposed relation to a backup member, wherein the print head has an outer surface generally opposite the print head print surface. The method also includes the step of applying a force against an adjustably positionable load transfer member in order to press the print head against the backup member. The magnitude of the force is determined by the point of application of the force on the load transfer member. The method further includes the step of adjusting the position of the load transfer member in order to exert a desired level of print head pressure against the backup member.

BRIEF DESCRIPTION OF THE DRAWINGS

The various objects, advantages, and novel features of the present invention will be more readily understood from the following detailed description when read in conjunction with the accompanying drawings, in which.

DETAILED DESCRIPTION OF THE PREFERRED EMBODIMENT

Figure 1:
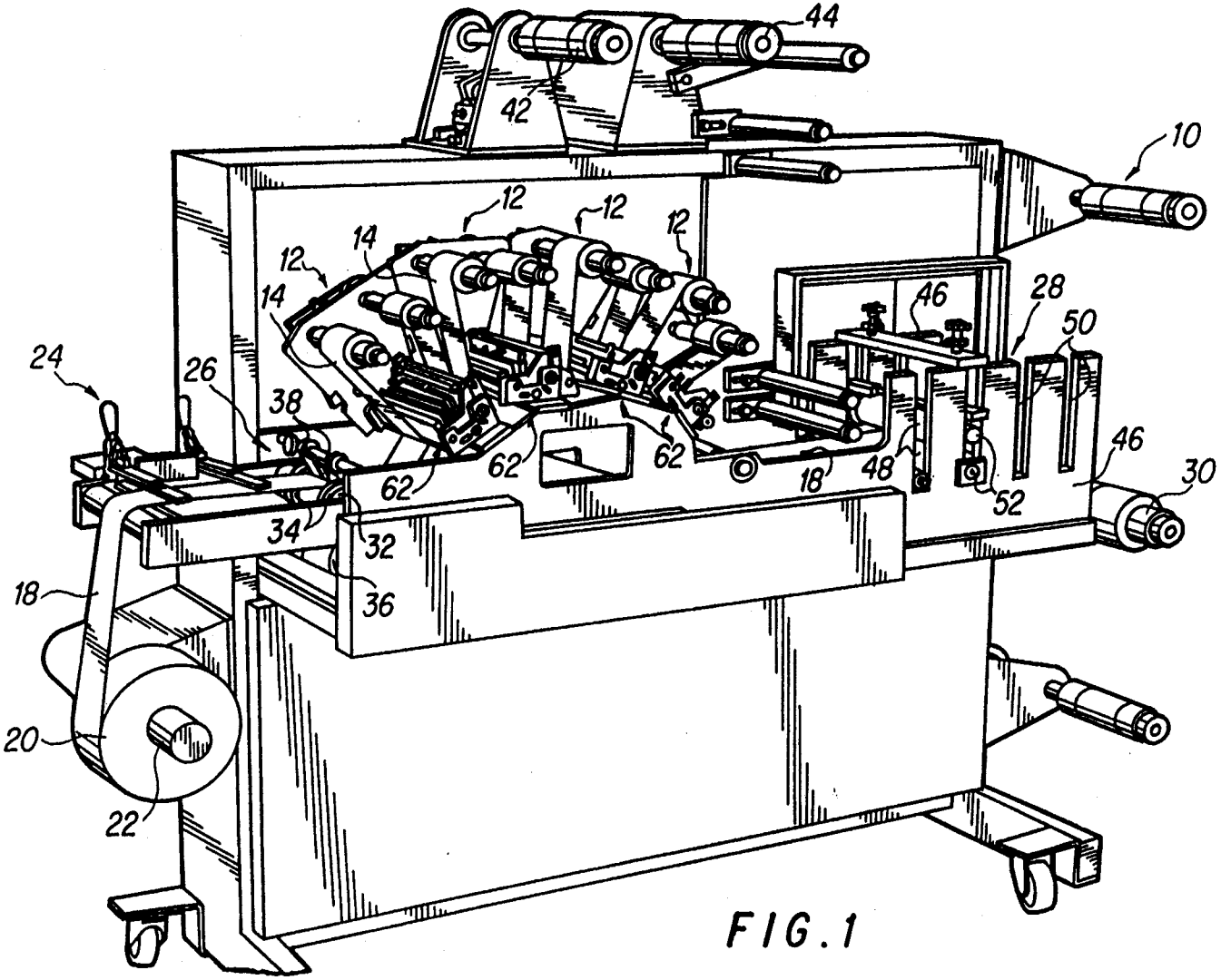
FIG. 1 is a perspective view of a multi-color thermal transfer printing apparatus in accordance with the present invention.

FIG. 1 illustrates a multi-color thermal transfer printing apparatus 10 in accordance with the present invention. The apparatus 10 is intended primarily for printing on paper label stock, but may be used for printing on other types of stock material. The apparatus includes a series of thermal print stations 12 arranged in a generally arcuate configuration. Each of the print stations 12 is provided with pre-selected color ink foil 14 and a thermal print head 16 (FIG. 2) for selectively transferring ink from the respective ink foil 14 to a label stock web 18 by thermal energy. The print stations 12 are essentially identical with the only difference between print stations 12 being the positions thereof and the use of different colors or types of ink foils if desired. For clarity, the components of only one print station will be described herein with the understanding that the remaining print stations comprise the same components.

The label web 18 is drawn from a label supply roll 20 supported by a spindle 22 at one end of the printing apparatus 10 and is drawn over a splicing table 24 before being threaded through a tensioning station 26 and then through the print stations 12 for printing. At the splicing table 24, a fresh label stock web may be attached to the label stock web already threaded through the print stations 12 in order to avoid rethreading of the new label web. After printing, the label web 18 is delivered to a cutting station 28 where the labels may be die cut and laminated if desired. Any remaining web is rolled onto a tensioned rewind spindle 30 at the end of the printing apparatus 10.

At the tensioning station 26, the label web is placed under tension and is centered. The web wraps around a fixed bar 32 (FIG. 2) between two adjustable guide collars 34 that center the web 18 and then wraps around a lower roller 36 before being directed to the first print station. A pair of pressure fingers 38 press the label web 18 against the fixed bar 32. In order to produce a proper tensioning of the label web 18, the label web preferably is turned through an angle of greater than 90° before wrapping around the lower roller 36.

The label web 18 is drawn through the print stations 12 by a pair of nip rollers 40 and 41 (FIG. 2) located downstream of the print stations 12. One of the nip rollers is a precision ground steel roller 40 coupled to a drive unit 43. Due to the precision grinding of the drive nip roller 40, the speed of the web 18 can be precisely controlled.

At the cutting and lamination station 28, the printed label web 18 can be laminated and individual labels cut if desired. A laminate supply spindle 44 is provided near the top of the apparatus 10 for holding a conventional laminate supply roll. Typically, the laminate is supported on a carrier web. A rewind spindle 42 positioned adjacent the laminate supply spindle is provided to rewind the carrier web once it has been separated from the laminate. The cutting and lamination station 28 includes a pair of spaced-apart support plates 46 that are mounted to the framing structure of the apparatus 10. The support plates 46 are designed to support various conventional tools 48 used for laminating, cutting, and slicing stock material. The support plates 46 each include a plurality of open-ended slots 50 that are aligned opposite the slots of the opposing support plate. The ends 52 of conventional die cutter rolls, anvil rolls, elastomer laminating rolls, slicing rolls and/or other conventional label finishing tools 48 may be slipped between respective slots 50 of the support plates 46 so that the respective rolls extend between the two plates. Below each set of support plate slots is a drive shaft (not shown) coupled to a drive unit. Mounted to the drive shaft is a gear that can engage the gears of the finishing tools for rotation.

With reference to FIGS. 2–6, the printing apparatus 10 preferably employs conventional thermal print heads 16 in order to reduce costs associated with manufacturing of the apparatus and in order to improve the reliability of the printing by using print heads having a proven record of durability. Such conventional thermal transfer print heads are available from Kyocera Corporation of Kyoto, Japan. The print heads 16 have a ceramic substrate 54 with a row of 2,592 thermal elements (not shown) on one side of the substrate near the forward end 56 thereof. Each thermal element has an approximately 0.003 inch width and protrudes slightly from the substrate 54. The same side of the ceramic substrate 54 also has the electronic circuitry (not shown) required for controlling the heating of the thermal elements. A shield 58 protects the circuitry of the print head 16. The print head electronics are connected to a computer which sends command signals for selected heating elements to be activated. On the opposite side of the ceramic substrate 54 is a heat sink 60.

Each print head 16 is supported by a printing assembly 62 mounted to a respective foil support plate 64. The foil support plate 64 is provided with a foil supply spindle 66 and a tensioned foil rewind spindle 68. Ink foil 14 is drawn from the foil supply spindle and through the printing assembly 62 by a pair of foil nip rollers 70 and 72 disposed within the printing assembly 62. The used foil is then wound about the foil rewind spindle 68.

The printing assembly 62 comprises two major subassemblies, a pivoting sub-assembly 74 that supports the print head 16 and a stationary sub-assembly 76 that supports a rubber platen 78 against which the print head 16 operates. The pivoting sub-assembly 74 is mounted to a pivot shaft 80 that allows the sub-assembly 74 to be pivoted into and out of pressure contact with the platen 78, in order to provide convenient access to the print head 16 for maintenance operations. The pivot shaft 80 is mounted at one end to a stationary end plate 82 that forms a part of the stationary sub-assembly 76 and at the opposite end to the foil support plate 64.

The pivoting sub-assembly 74 includes a heat sink 84 to which the print head 16 is mounted. The heat sink 84 provides additional cooling for the print head 16 and is formed from a plurality of spaced-apart aluminum heat fins 86 that extend transversely across the printing assembly 62 and that are supported by an aluminum base 88. The print head 16 is fastened to the opposite side of the heat sink base 88 by a plurality of spring-released screws 90 that are attached to the base 88. A holding rod 92 passing through the heat sink 84 couples the heat sink to a pivot bar 94 which in turn is coupled to the pivot shaft 80 so that the pivot bar 94, together with the heat sink and print head, can pivot about the pivot shaft. The pivot bar 94 extends transversely across the printing assembly 62 and has a pair of arms 96 at opposing ends that are coupled to the pivot shaft 80 by conventional bushings to allow the pivot bar 94 to pivot freely about the pivot shaft 80. Clamped on either side of the pivot bar arms 96 are levers 98 that extend underneath the base 88 of the heat sink 84 so that, when the pivot shaft 80 is rotated, the levers 98 will engage the bottom surface of the heat sink 84 causing the heat sink 84 and print head 16 to raise up.

Also attached to the pivot shaft 80 is a pair of pivoting end plates 100 that support the remaining components of the pivoting sub-assembly 74. Among these components is a foil guide shaft 102 positioned below the pivot shaft 80 with its ends attached to the respective pivoting end plates 100. As explained in more detail further below, the foil guide shaft 102 serves to guide the ink foil 14 to the print head 16.

Also coupled to the pivoting end plates 100 adjacent to the print head 16 is a peeler bar 104. The peeler bar 104 is a substantially flat steel plate with a lower lip 106 that engages the ink foil 14 after it has passed the print head 16 in order to redirect the travel of the foil 14 away from the printed label web 18. The peeler bar 104 is mounted to a support bar 108 that is fixedly attached at either end to the pivoting end plates 100. The mounting is achieved by bolts 110 that pass through respective slots 112 to engage the support bar 108. The slots 112 enable the peeler bar 104 to shift slightly with respect to the support bar 108 so that the peeler bar 104 may be adjusted to a different level or incline for different types of label stock and/or ink foil. The upper part 114 of the peeler bar 104 is bent perpendicularly and is provided with a pair of spring-loaded thumb screws 116 for adjusting the position of the peeler bar. The adjustments may be made by turning one or both of the screws 116 to bring the lower ends 118 thereof into contact with the upper surface 120 of the support bar 108. Further turning of a screw 116 will cause the peeler bar 104 to raise up slightly on the side of the particular screw being manipulated.

The pivoting end plates 100 also support a shaft 122. The shaft 122 extends between the two end plates 100 adjacent to the peeler bar 104 and in turn supports a biasing member in the form of a steel spring 124. The steel spring 124 preferably is a flat member that is attached to the shaft 122 at one end with its opposite end extending toward the peeler bar 104 and through an opening 126 provided in the peeler bar 104. As explained in more detail further below, the steel spring 124 and shaft 122 constitute a biasing system for adjusting the pressure of the print head 16 against the rubber platen 78. Also positioned adjacent the peeler bar 104 but below the shaft 122 is one of the foil nip rollers that draw the ink foil from the foil supply spindle 22 and through the printing assembly. The foil nip roller 70 is attached at either end to the pivoting end plates 100 for free rotation and, preferably, has an elastomeric outer surface.

In order to hold the pivoting assembly 74 down and locked in the operating position, a pair of latch mechanisms 130 are attached to the outside of the pivoting end plates 100. Each latch 130 includes an indent 132 at a lower end thereof that engages respective pins 134 attached to the stationary end plate 82 and the foil support plate 64. A dowel pin 136 is attached to one latch to allow an operator to disengage the latches 130 from the respective pins 134 and pivot the sub-assembly 74 away from the platen 78.

The stationary end plate 82 of the stationary sub-assembly 76 is mounted to a base plate 138 that extends transversely beneath the printing assembly 62 and is attached to the frame structure of the printing apparatus 10. Opposing ends of the rubber platen 78 are pivotally mounted to the foil support plate 64 and the stationary end plate 82, respectively, such that the rubber platen 78 may freely rotate as the label web 18 passes thereover. Also mounted between the stationary end plate 82 and the foil support plate 64 is the second of the pair of foil nip rollers. This second foil nip roller 72 is driven by a driving unit 142 mounted to the back of the foil support plate 64.

Figure 3:
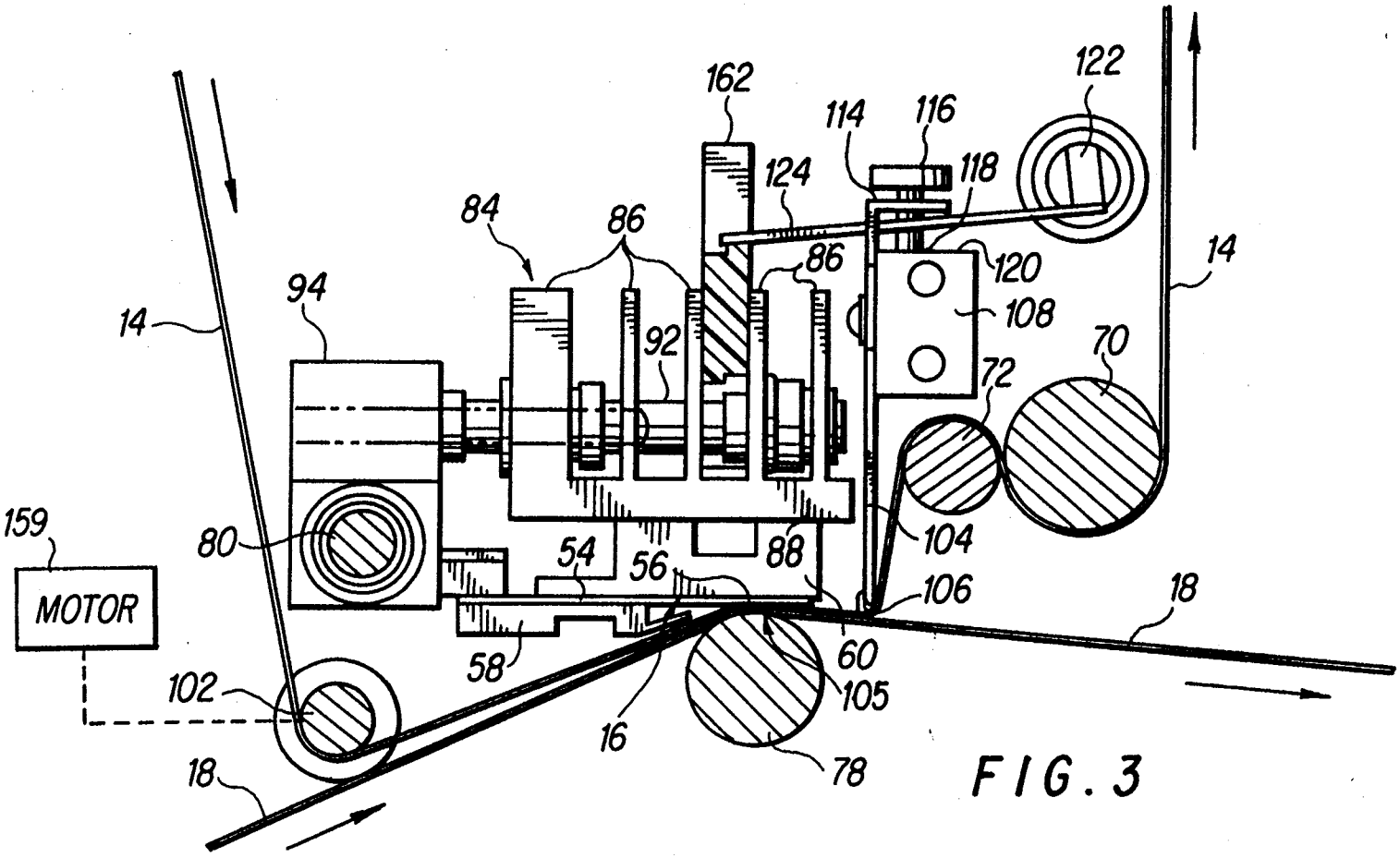
FIG. 3 is a side view of a printing assembly of the printing apparatus with various components removed for clarity.
Figure 4:
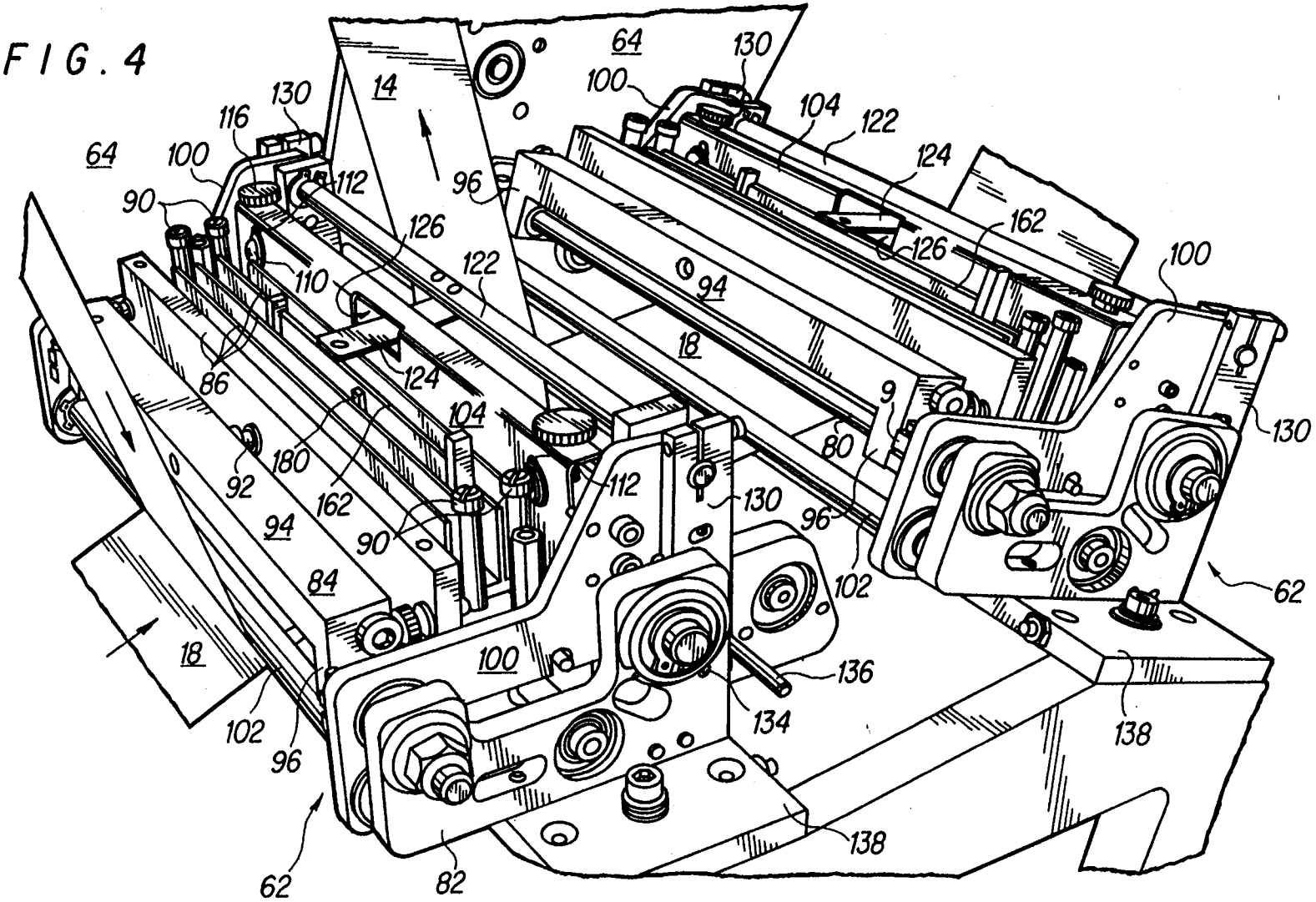
FIG. 4 is a perspective view of two adjacent printing assemblies in operating position.

FIGS. 3 and 4 illustrate the printing assembly 62 in operating position whereby the thermal elements of the printhead 16 have been brought into pressure contact with the foil 14 and web 18 against the rubber platen 78. The length of the pressure contact area 105 corresponds generally to the length of the row of thermal elements. However, due to the resiliency of the rubber platen 78, and dependent upon the amount of pressure applied, the pressure contact area may be wider than the width of the individual thermal elements, so that a portion of the ceramic substrate 54 adjacent to the elements also comes into pressure contact with the platen 78. The pressure contact area preferably has a minimal width in the range of 0.010 to 0.020 inch.

When in the operating position, the passive foil nip roller 70 (i.e., the free-turning nip roller) of the pivoting sub-assembly 74 is positioned adjacent to the driven foil nip roller 72 of the stationary sub-assembly 76. The ink foil 14 is threaded around the foil guide shaft 102, between the print head 16 and rubber platen 78, and around the lower lip 106 of the peeler bar 104. The ink foil 14 is then threaded between the driven foil nip roller 72 and the passive foil nip roller 70 and is directed to the foil rewind spindle 68. The rewind spindle 68 is preferably tensioned to continually take up any slack between the foil nip rollers 70 and 72 and the spindle 68 and to wind the spent foil about the spindle 68. The foil guide shaft 102 is positioned so that the ink foil 14 is introduced to the pressure contact area or print surface 105 without contacting the electronics shield 58 of the print head 16.

Figure 6:
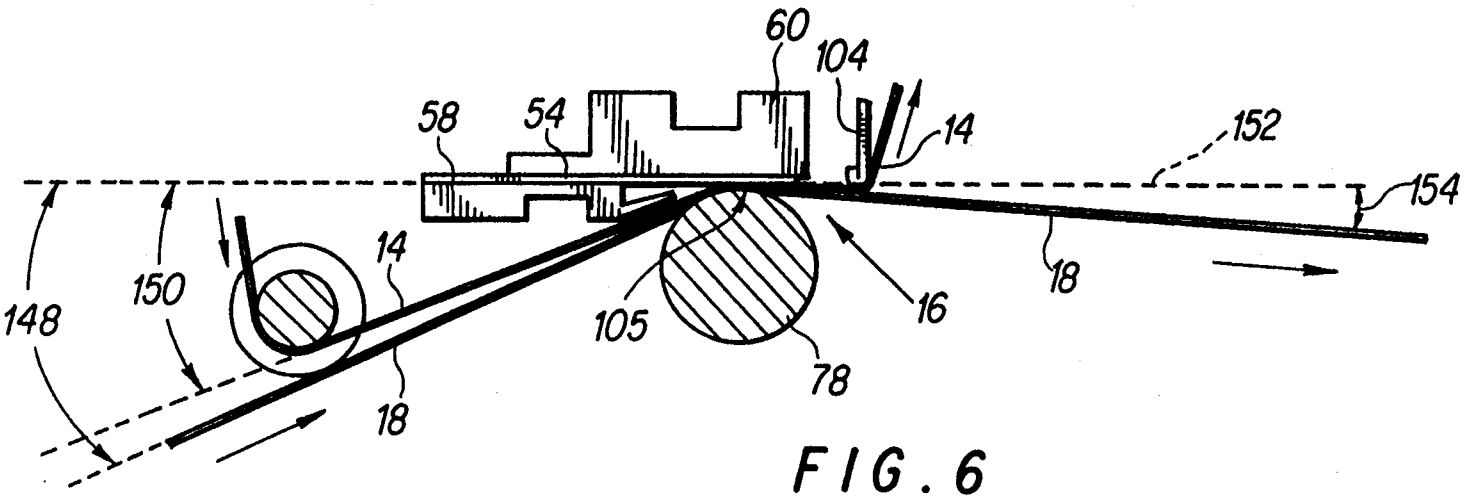
FIG. 6 is a schematic side view of the print head illustrating the direction of travel of the label web and ink foil past the print head.

Likewise, the label web 18 is introduced to the pressure contact area or print surface 105 of the print head at an angle sufficient to avoid contact with the electronics shield 58 before being compressed between the print head 16 and the rubber platen 78. As shown, the label web 18 is positioned between the ink foil 14 and the platen 78. Both the label web 18 and ink foil 14 preferably exit the pressure contact area or print surface 105 at a slight angle so that they do not rub against the print head. The angle, however, is kept relatively small so that minimal wrapping of the web and foil about the rubber platen will occur. FIG. 6 more clearly illustrates the entering and exiting angles of the label web 18 and ink foil 14 to and from the pressure contact area or print surface. Preferably, the entering angles 148 and 150 of the label web 18 and ink foil 14 with respect to the printing plane 152 are in the range of 20° to 30°, and the exiting angle 154 for both the foil 14 and web 18 is approximately 5°.

Figure 2:
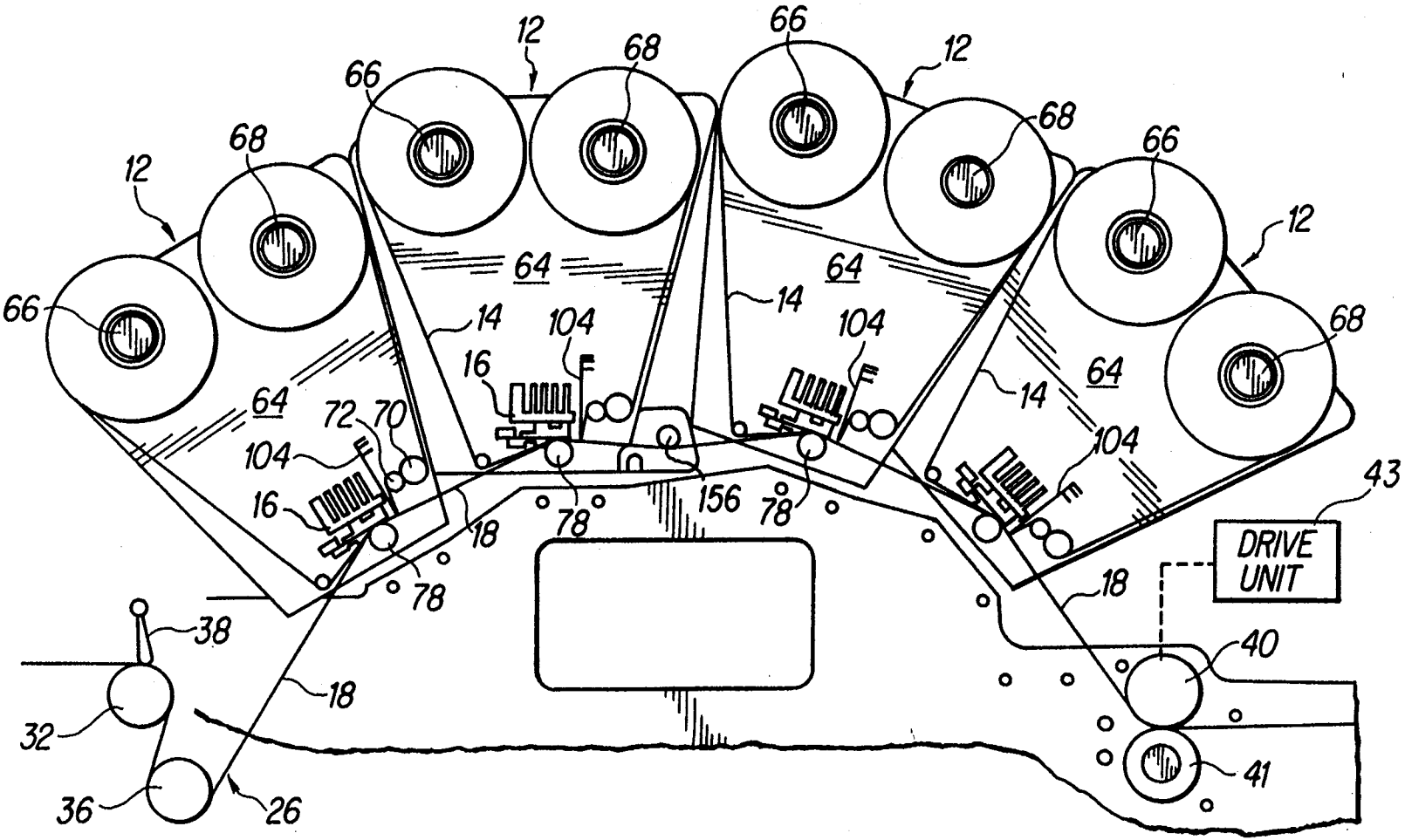
FIG. 2 is a partial schematic side view of the print stations of the printing apparatus.

With reference to FIG. 2, each of the print stations 12 is positioned with respect to a preceding print station so that the label web 18 follows a substantially straight path from one station to the next. In other words, a succeeding print station is positioned so that the plane along which the web 18 travels when exiting the preceding print head is the substantially same plane along which the web must travel in order to clear the electronics of the succeeding print station. By positioning the print station so that the label web 18 can follow a substantially straight path from the printing zone of one print station to the next, additional rollers are not necessary in order to change the direction of an exiting label web so that it will be at the proper angle for introduction to a subsequent print head. Such rollers, for example, would be necessary if the print stations were arranged in a line. These additional rollers make it difficult to place the print stations close together; moreover, wrapping the label web around the additional rollers can cause registration errors. To reduce registration errors, a minimum amount of label web should be present between print stations 12 so that the position of the label area on the label web can be more accurately determined and, therefore, the timing for printing of different colors can be more accurately achieved.

Figure 5:
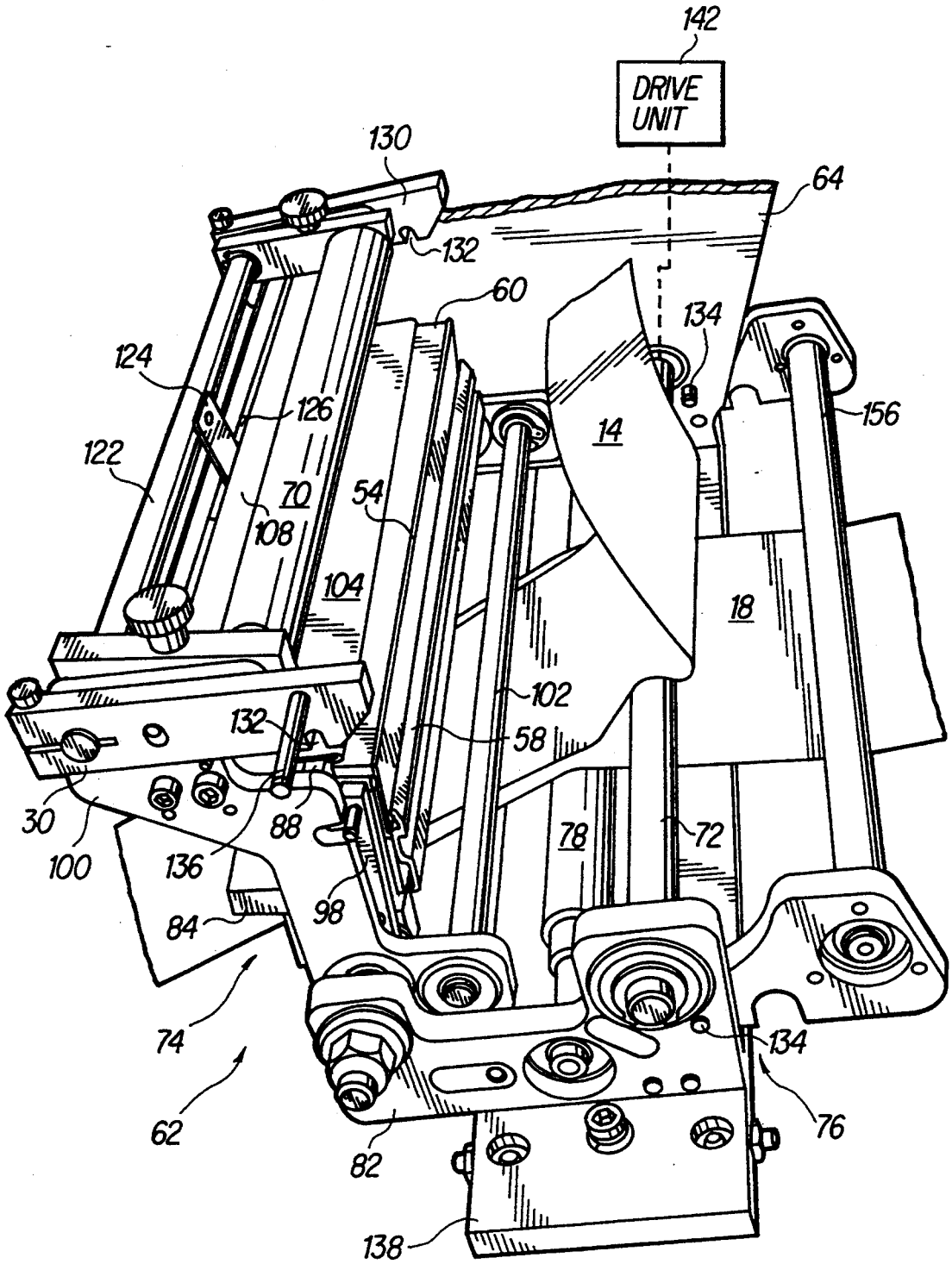
FIG. 5 is a perspective view of a printing assembly with the print head pivoted away from operating position.

With reference to FIGS. 2 and 5, an encoder shaft 156 is preferably positioned between the second and third print stations. The encoder shaft 156 is coupled to a conventional encoder (not shown) for monitoring the movement of the label web 18. The encoder signals are delivered to the computer for processing in order to assist in the timing of the printing. The encoder shaft 156 causes a slight deviation in the direction of travel of the label web 18 between the second and third print stations. However, the label path is still substantially straight. Such minor deviations from a straight line path may be necessary for particular printing functions, and it is contemplated that such deviations in web path fall within the scope of the invention. As will be readily understood by one of ordinary skill in the art, the print stations 12 do not necessarily need to be arranged in a uniform arcuate configuration as shown. Rather, the print stations are positioned depending on the angle of introduction necessary to clear the electronics shields of the particular print head employed. Consequently, the print stations may be angled more or less sharply with respect to each other.

In operation, the label web 18 is drawn past the print stations 12 at a constant speed that is controlled by a computer. This speed, however, can be adjusted for different printing operations. The ink foils 14 of the individual print stations 12 are separately driven at a speed matching the speed of the label web 18. Selective print heads 16 of the print stations are activated when the corresponding colors are desired for printing. Preferably, when a particular color is not necessary, the corresponding foil and print head are lifted away from the label web and movement of the foil is stopped in order to conserve foil. In order to lift the ink foil and print head slightly, each of the pivot shafts 80 of the print stations 12 is coupled to a separate stepper motor 159 mounted to the back of the foil support plates, which can be activated to slightly turn the pivot shaft 80 and thereby raise the levers 98 into contact with the lower surface of the heat sink 84. This causes the print head 16 to lift slightly away from contact with the label web. The raising and lowering of the print head 16 can be achieved without stopping the movement of the label web 18 and without pivoting the entire pivoting sub-assembly 74 away from the platen 78. Preferably, however, before lowering the print head 16 to resume printing, the foil 14 is advanced at a speed that matches or slightly exceeds the speed of the label web 18, so that when contact is made against the moving web 18 no scuffing of the web 18 will take place. This will also insure that the label web speed remains unaltered so that proper print-to-print registration can be maintained.

Figure 7:
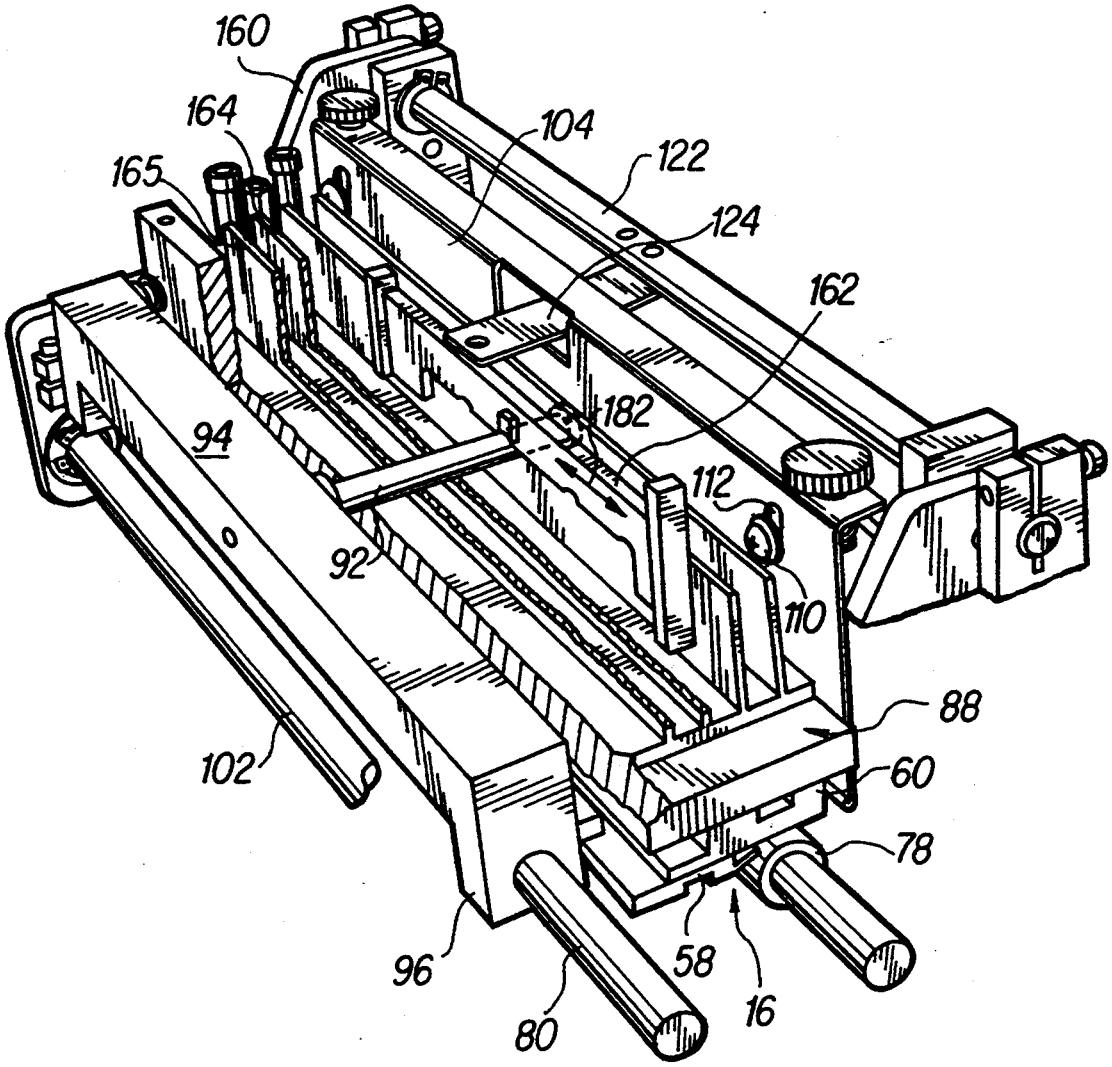
FIG. 7 is a partial cut-away perspective view of the printing assembly illustrating a print head pressure adjustment mechanism in accordance with the present invention.
Figure 8:
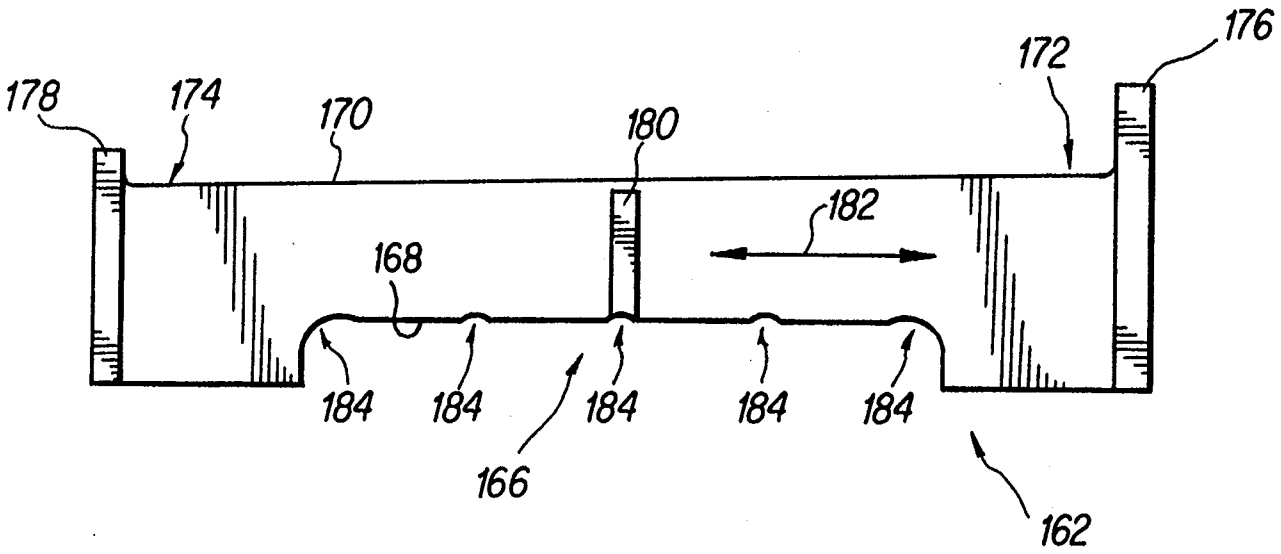
FIG. 8 is a side view of a sliding adjuster used in the print head pressure adjustment mechanism.

In the preferred embodiment of the invention, the printing assembly 62 is provided with a pressure adjustment mechanism. The particular print head pressure required for satisfactory printing varies with the width of the web 18 and/or ink foil 14 used. Printing widths can vary considerably, with the typical range being from 4.5 to 8.7 inches. For a wider widths of web or foil, increased print head pressure is required. As mentioned above, the adjustment mechanism includes a biasing system comprising a steel spring 124 that is mounted to the shaft 122 of the pivoting sub-assembly 74. With reference to FIGS. 7 and 8, the mechanism also includes a sliding adjuster 162 that is positioned between two adjacent heat fins 164 and 165 of the heat sink, substantially above the thermal elements of the print head 16. The sliding adjuster 162, which serves as an adjustably positionable load transfer member preferably is a relatively thin member with a generally U-shaped cutout portion 166 having a load transfer surface 168. The sliding adjuster 162 also has an upper bearing surface 170 that preferably is substantially flat with a slight incline. In a preferred embodiment, the bearing surface is approximately 5.126 inches long with one end 172 being approximately 0.083 inches higher than the other end 174. A pair of guide posts 176 and 178 are positioned at both ends of the adjuster 162 and are slightly wider than the width of the bearing surface to enable the adjuster 162 to stand upright when inserted between the heat fins 164 and 165 of the heat sink 84. The adjuster 162 may also have a central brace 180 for providing additional upright support. Alternatively, the adjuster may have a constant thickness that is slightly less than the distance between the two heat fins between which it is positioned.

The adjuster 162 is positioned between two heat fins with the load transfer surface 168 engaging the top of the rod 92 that mounts the heat sink 84 to the pivot bar 94. The upper bearing surface 170 is positioned beneath the steel spring 124 so that the steel spring presses against the bearing surface. The steel spring 124 is biased to apply a constant pressure to the adjuster 162 and through the adjuster 162 to the print head 16, thereby causing the print head 16 underneath the adjuster 162 to press against the rubber platen 78. Preferably, the steel spring 124 is positioned centrally and the adjuster 162 is positioned directly above the thermal elements so that the load applied by the steel spring 124 is also above the thermal elements. Such an arrangement will minimize excessive torques that may cause an unequal pressure to be applied to the rubber platen 78 along the row of thermal elements. Pressure adjustments may be made by sliding the adjuster 162 laterally between the two heat fins, as shown by the arrows 182, with the upper bearing surface 170 acting as a cam that resists the pressure of the steel spring 124. Maximum pressure is applied when the adjuster 162 is positioned so that the steel spring 124 is adjacent to the higher end 172 of the bearing surface 170, and minimum pressure is applied when the spring is at the lower end 174. Between these two positions, an infinite range of print head pressures may be achieved by sliding the adjuster 162 from side to side.

In the preferred embodiment, the load transfer surface 168 is provided with a plurality of indents 184 that slightly grip the upper surface of the holding rod 92 in order to hold the adjuster 162 in a particular lateral position. The position of the indents 184 may be selected to correspond to a particular print head pressure so that when that particular print head pressure is required, the adjuster 162 may be moved so that the appropriate indent engages the holding rod. The adjuster 162 preferably comprises a plastic with a relatively low coefficient of friction so that the spring 124 can easily slide over the bearing surface 170. A preferred material is acetal sold under the trade name Delrin, which is available from E.I. Du Pont De Nemours and Company of Wilmington, Del. The adjuster 162, however, may be made of other suitable materials, such as metals, and covered with a nonstick coating such as polytetrafluoroethylene to achieve the necessary reduction in surface friction.

In operation, the adjuster may be manually moved by an operator during printing whenever a print head pressure adjustment is needed. Preferably, the guide post on the higher end of the bearing surface is taller than the other guide post, so that the operator can easily recognize which direction to move the adjuster in order to obtain the maximum print head pressure. The operator does not need to stop printing in order to make a pressure adjustment. The adjustment mechanism provides a simple yet effective means to adjust the print head pressure over an infinite range without stopping the printing process.

Although the present invention has been described with reference to a preferred embodiment, the invention is not limited to the details thereof. Various substitutions and modifications will occur to those of ordinary skill in the art, and all such substitutions and modifications are intended to fall within the scope of the invention as defined in the appended claims.

What is claimed is:

1. A system for adjusting the pressure of a print head with respect to a backup member, comprising:

a print head having a print surface and an outer surface generally opposite to said print surface;

a backup member positioned adjacent to the print surface of said print head;

an elongated member slidably displaceable with respect to the outer surface of said print head, said elongated member defining a load transfer surface adjacent to the outer surface of said print head and a bearing surface generally opposite to said load transfer surface, with the distance between said bearing surface and the print surface of said print head being dependent on the slidable position of said elongated member with respect to the outer surface of said print head; and a biasing system engagable with the bearing surface of said elongated member and operable to transfer force through said load transfer surface to urge said print head toward said backup member.

2. A system according to claim 1, wherein said bearing and load transfer surfaces are oriented along generally convergent planes and said biasing system comprises a fixedly positioned spring member engagable with said bearing surface.

3. A system according to claim 1, wherein said bearing surface is formed along an upper end of the elongated member and is angularly inclined with respect to said load transfer surface.

4. A system according to claim 1, further comprising a pair of vertically oriented, generally parallel plates connectable to the outer surface of the print head, said plates defining a channel therebetween, said elongated member being slidably positioned within said channel.

5. A system according to claim 4, further comprising means for fixing the slidable position of said elongated member within said channel.

6. A system according to claim 5, wherein said elongated member position fixing means comprises a rod which extends across at least a portion of said channel and a plurality of recesses formed in said elongated member, said recesses being configured to receive at least a portion of said rod.

7. A system according to claim 6, wherein said recesses are formed along said load transfer surface.

8. A method for adjusting the pressure exerted by a print head with respect to a backup member, comprising the steps of:

positioning a print head in opposed relation to a print head backup member, said print head having a print head surface adjacent to said backup member and an outer surface generally opposite to said print head print surface;

placing an adjustably .positionable load transfer member in contact with the outer surface of said print head;

applying a force against a point on said adjustably positionable load transfer member to press the print head against the backup member, said force having a magnitude determined by the point of application of the force on the load transfer member; and adjusting the position of the load transfer member in order to exert a desired level of print head pressure against the backup member.

9. The method of claim 8, wherein said force is applied substantially directly above said print head print surface with said load transfer member transferring the force to said print head print surface.

10. The method of claim 8, wherein the print head outer surface comprises a heat sink having at least two outwardly extending fins, and wherein the load transfer member is slidably displaceable within a channel extending between said fins.

11. The method of claim 8, wherein said desired level of print head pressure is obtained by providing the load transfer member with an inclined bearing surface and applying a biasing member against said bearing surface.

12. The method of claim 11, further comprising the step of selecting one of a plurality of discrete force application positions along the bearing surface of the load transfer member to exert a variable print head pressure.

13. The method of claim 11, wherein said biasing member maintains a substantially fixed position during adjustment of the position of the load transfer member.

* * * * *